United States Patent [19]

Failor et al.

[11] Patent Number: 4,858,260

[45] Date of Patent: Aug. 22, 1989

[54] PATIENT TRANSPORT APPARATUS INCLUDING TRENDELENBURG MECHANISM AND GUARD RAIL

[75] Inventors: Raymond A. Failor, Seville; Eugene Hayton, Medina; Mark Reuter, Chippewa, all of Ohio

[73] Assignee: Hausted, Inc., Medina, Ohio

[21] Appl. No.: 166,675

[22] Filed: Mar. 11, 1988

[51] Int. Cl.[4] ..... A61G 7/00

[52] U.S. Cl. ..... 5/67; 5/430; 297/90; 267/131; 267/117

[58] Field of Search ..... 5/66, 67, 68, 70, 71, 5/72, 432, 433; 297/90, 355; 267/117, 131

[56] References Cited

U.S. PATENT DOCUMENTS

| | | | |
|---|---|---|---|
| 2,658,210 | 11/1953 | Travis | 5/68 |
| 2,819,475 | 1/1958 | Ericsson | 5/72 X |
| 3,585,659 | 6/1971 | Burst et al. | 5/430 |
| 3,855,654 | 12/1974 | Pivacek | 5/429 |
| 3,932,903 | 1/1976 | Adams et al. | 5/100 |
| 4,236,261 | 12/1980 | Huempfner | 5/66 X |
| 4,535,762 | 8/1985 | Natchev | 5/67 X |
| 4,679,849 | 7/1987 | Torgny | 5/67 X |
| 4,685,159 | 8/1987 | Oetiker | 5/68 X |
| 4,751,755 | 1/1988 | Carey, Jr. et al. | 74/500.5 X |

FOREIGN PATENT DOCUMENTS

| | | | |
|---|---|---|---|
| 1506579 | 11/1966 | France | 5/66 |

OTHER PUBLICATIONS

Stretchair Brochure, Medical Laboratory Automation, Inc., 11/84.
Trans-Aid Brochure, Undated.
Trade West Advertisement, Undated.
Lumex Brochure, 1986.
Hausted Inval-Aid Chair Catalog Page, 1983.

*Primary Examiner*—Gary L. Smith
*Assistant Examiner*—Michael Milano
*Attorney, Agent, or Firm*—Hoffman & Baron

[57] ABSTRACT

A multi-purpose patient support and transport apparatus is provided which includes a Trendelenburg mechanism and a novel guard rail assembly. The Trendelenburg mechanism is actuated by turning a handle in one direction. This allows a pneumatic spring connected between the seat and backrest assemblies to be fully contracted, thereby moving the backrest assembly to a Trendelenburg position. When the handle is turned in the opposite direction, the backrest may also be rotated downwardly, but is precluded from moving beyond the reclining position by a stop member which prevents the pneumatic spring shaft from moving entirely within the spring casing. The guard rail is mounted to the frame of the apparatus by a pair of pivot arms extending at an oblique angle with respect to the plane of the rail. This allows the rail to be stored under the frame when in the lowered position.

13 Claims, 9 Drawing Sheets

PATIENT TRANSPORT APPARATUS INCLUDING TRENDELENBURG MECHANISM AND GUARD RAIL

BACKGROUND OF THE INVENTION

1. Field of the Invention

The field of the invention relates to multi-purpose patient transport assemblies, and guard rails for such assemblies and other purposes.

2. Brief Description of the Prior Art

A number of patient transport assemblies have been designed for allowing a patient to be maneuvered between sitting and supine positions. A lever may be employed for converting the unit from a fully upright seating position to any number of semi-prone and full prone stretcher positions. Guard rails and/or seat belts are provided for patient safety. Means are also provided for adjusting the height of the unit.

Guard rails are employed in conjunction with patient transport apparatus, hospital beds and related equipment for protecting a patient. The rails may be adjustable between raised and lowered positions to allow access to the patient. U.S. Pat. Nos. 3,081,463, 3,585,659, 3,839,753, 3,855,564, and 3,932,903 disclose guard rails which have been used in the medical industry.

SUMMARY OF THE INVENTION

The invention is directed to a chair/stretcher assembly having a seat portion, a backrest portion pivotably mounted near one side of the seat portion, and a leg rest portion pivotably mounted near the opposite side of the seat portion. Locking means are provided for allowing the backrest position to be maintained in any of a multitude of positions, including a horizontal position substantially coplanar with the seat portion, or in a Trendelenburg position. The locking means preferably includes an extensible assembly such as a pneumatic spring, which is pivotably mounted between the backrest portion and the unit's seat portion or frame assembly. The extensible assembly is fully extended when the backrest is in the upright position. It contracts as the backrest is lowered to the horizontal position. Stop means are provided for preventing further contraction of the extensible member when the backrest reaches the horizontal position. The stop means are movable to allow further contraction of the extensible member, thereby allowing the backrest to assume the Trendelenburg position.

The guard rail according to the invention includes a rail pivotably mounted to the frame of the unit by a pair of connecting members. At least one of the connecting members includes a notch and a pair of openings therein. One of the openings receives a pivot pin used for connecting the rail to the frame. A spring-loaded pin is also mounted to the frame. Means are provided for retracting this pin. When the rail is in the raised position, the spring-loaded pin moves within the second of the two openings within the connecting member, thereby maintaining the rail in this position. Retraction of the pin allows the rail to swing about the axes of the pivot pins to the lowered position. Movement of the pin into the notch locks the rail in this position. The connecting members preferably extend obliquely with respect to the rail to allow it to be stored under the seat portion when in the lowered position.

DETAILED DESCRIPTION OF THE INVENTION

Figure 1:
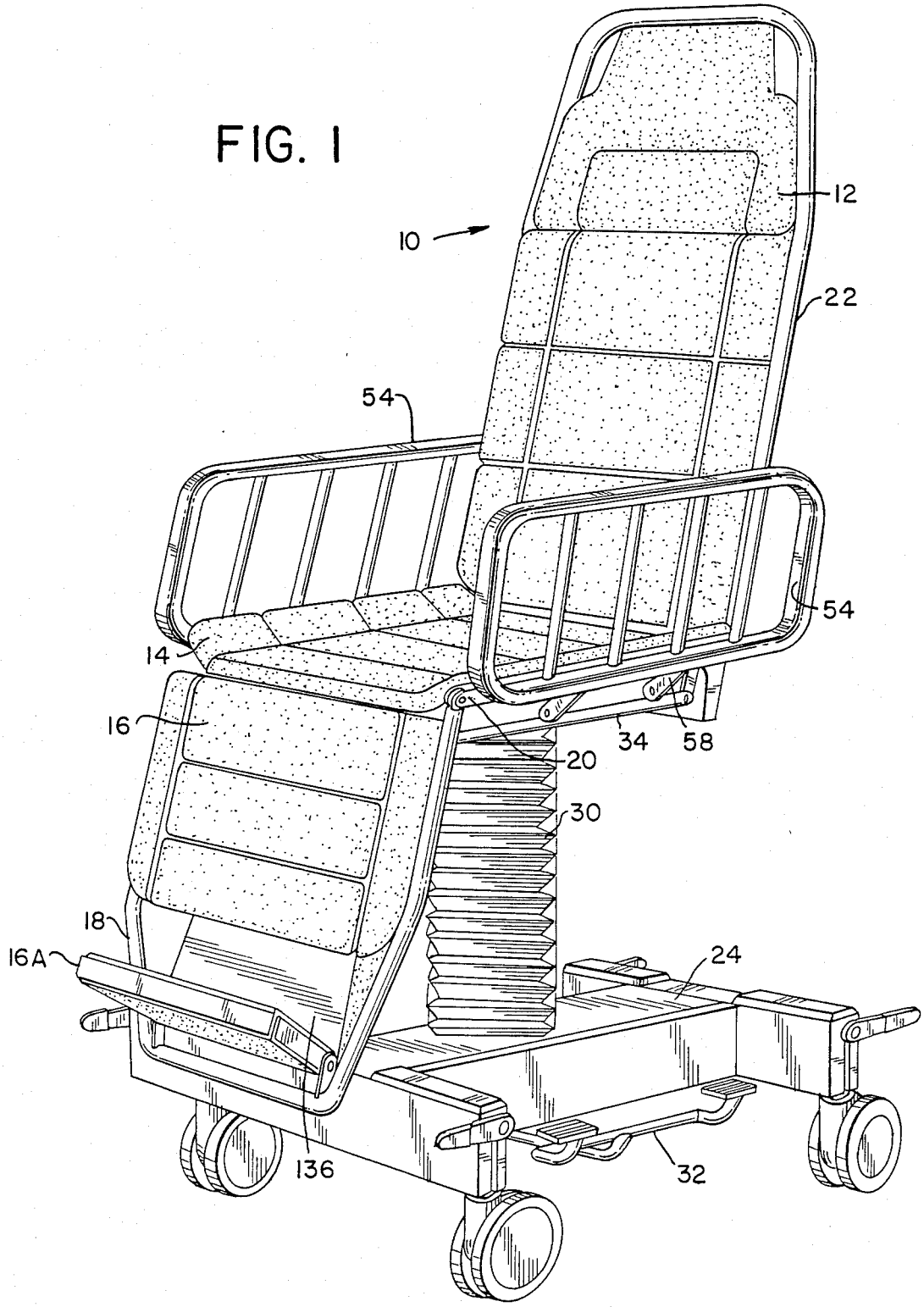
FIG. 1 is a perspective view of a chair/stretcher assembly in accordance with the invention.

A chair/stretcher assembly 10 is provided for transporting a patient in the seated position or the supine position. The assembly includes a backrest portion 12, a seat portion 14, and a leg supporting portion 16. The leg supporting portion includes a tubular steel frame 18 which is pivotably mounted to a seat portion frame 20. A footrest 16A is pivotably mounted to a pair of mounting tabs 18A. A backrest frame 22 is also pivotably mounted to the seat portion frame. A steel channel U-shaped frame 22A is pivotably mounted to the backrest frame 22 and is used as a push bar when transporting the assembly.

The seat portion is mounted to a mobile base 24 having a four wheel brake and steer caster system which is adjustable by means of a set of levers 26. A column 28 supports the seat portion. Hydraulic height adjustment means (not shown) are positioned within a polymeric casing 30. The casing 30 is formed as a bellows to allow the column to increase or decrease in height upon actuation of the hydraulic adjustment means. Foot pedal assemblies 32 mounted to each side of the unit are used to control height adjustment.

Figure 5:
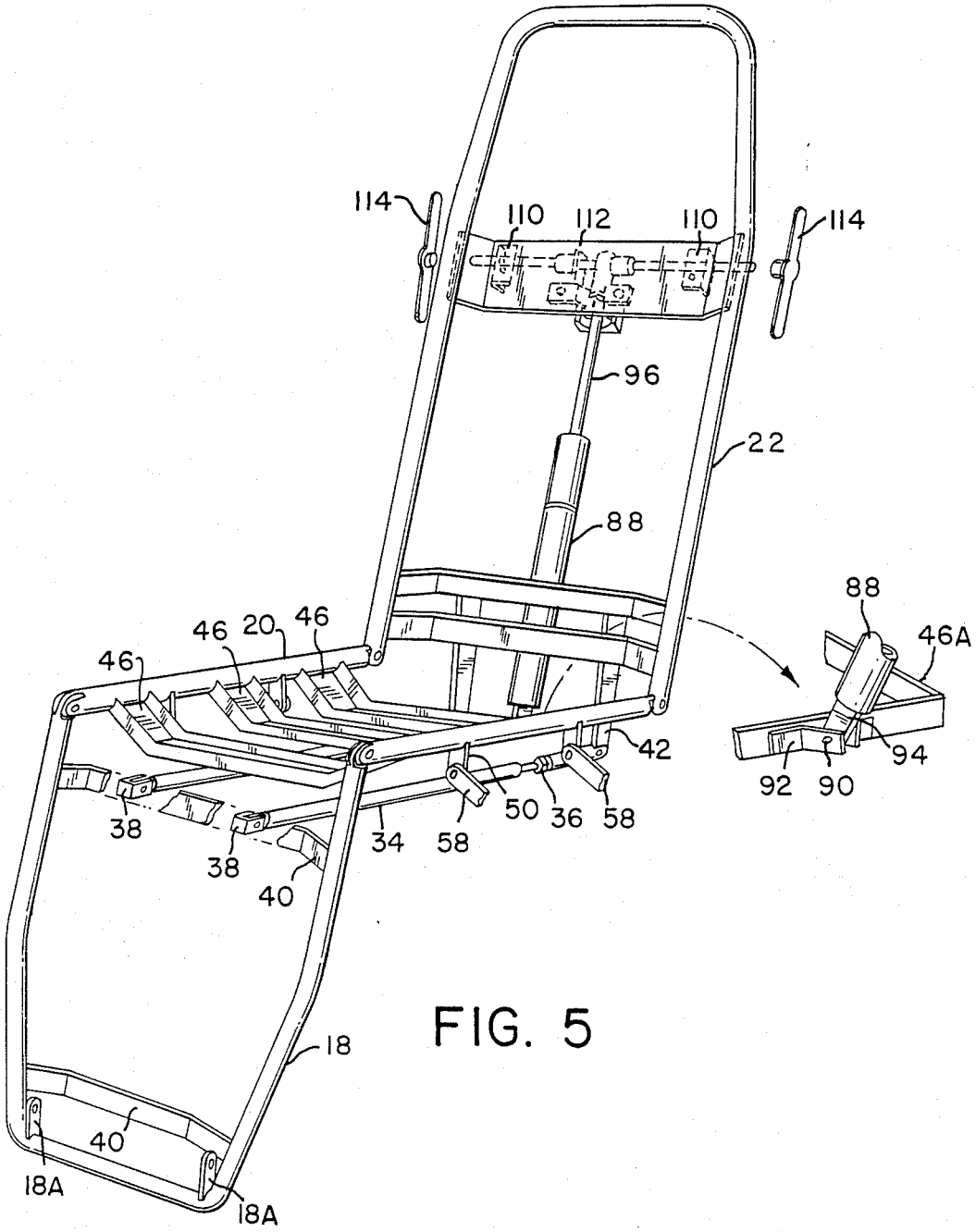
FIG. 5 is a perspective view of a frame assembly and related mechanical components of the chair/stretcher assembly.

A linkage assembly as shown in FIG. 5 connects the three frames 18, 20, 22 and causes the backrest portion 12 to remain either substantially parallel to or coplanar with the leg supporting portion 16 at all times. It includes a pair of connecting links 34, each having a threaded section with a jam nut 36. By loosening the jam nut, one section of the connecting link may be rotated with respect to the other, thereby increasing or decreasing its length. The nut is tightened once the length is properly adjusted.

The connecting links 34 are pivotably connected at one end to a pair of brackets 38. The brackets are mounted to one of the cross members 40 secured to the leg supporting frame 18. The opposite ends of the links are pivotably secured to a pair of supports 42 which are in turn mounted to a pair of cross members 44. The cross members 44 extend laterally between opposing lower portions of the backrest frame 22.

A plurality of U-shaped cross members 46 extend laterally between each tube defining the seat frame 20. A rearwardly extending U-shaped member 46A is mounted to the rear cross member 46. A seat cushion 48 is mounted to a plate supported by the cross members 46. A pair of downwardly extending projections 50 welded to each seat frame tube are used for mounting a pair of guard rail assemblies 52.

Each guard rail assembly includes a metal rail 54 having a rubber or polymeric bumper 56 secured thereto. A pair of pivot arms 58 extend at an oblique angle with respect to the plane defined by each rail. These arms are positioned between the downwardly extending projections 50 of the seat frame 20. Threaded holes 60 within the seat frame projections are aligned with a set of unthreaded holes 62 in the guard rail arms. A pair of partially threaded screws 64 extend through each of the holes 62 and are secured to the threaded holes 60. Each rail assembly is thereby pivotably secured to the seat frame 20.

Figure 11:
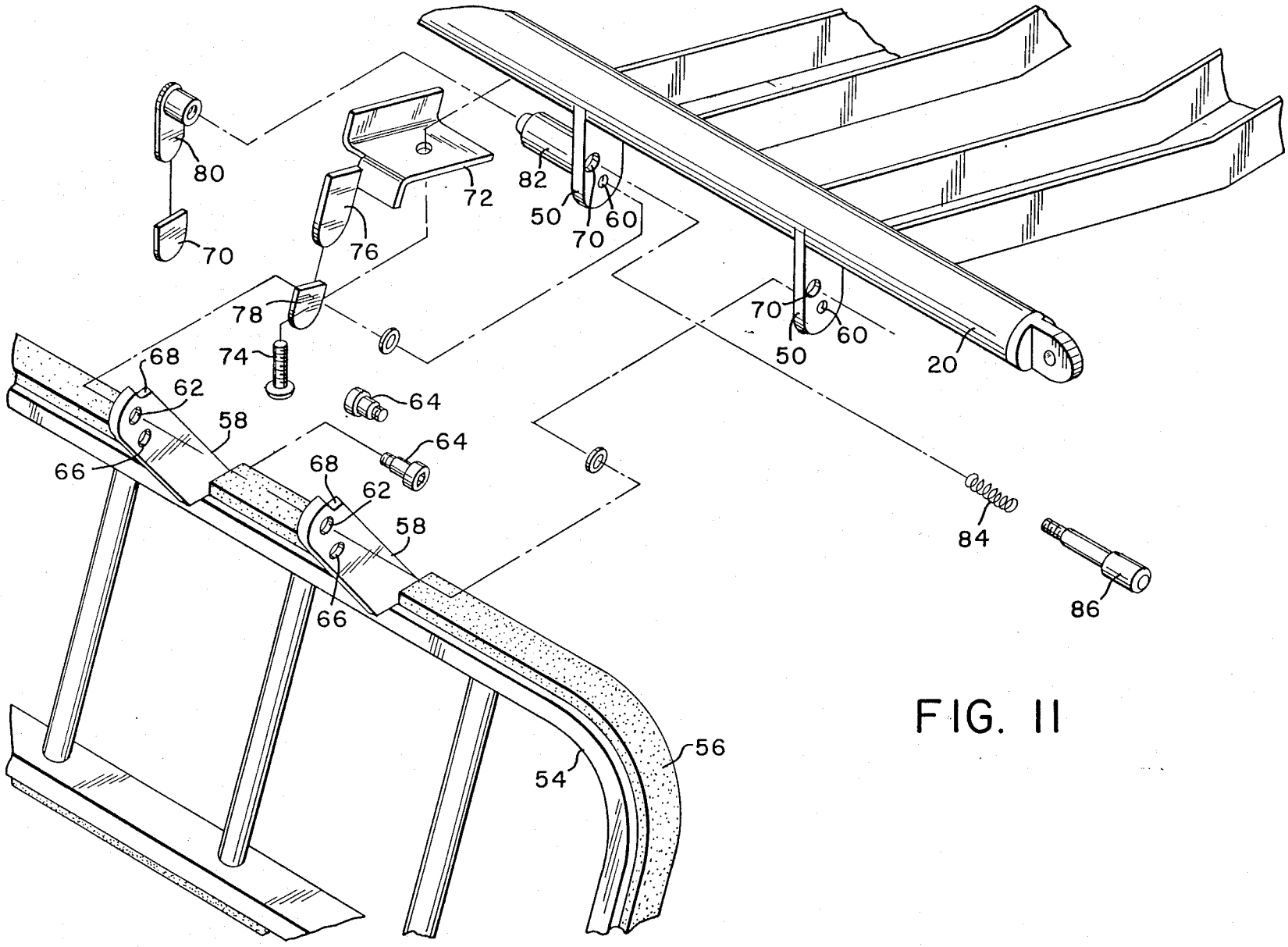
FIG. 11 is an exploded, perspective view of the guard rail mounting assembly.

Each pivot arm 58 includes a pin-receiving hole 66 therein as well as a notch 68 defined in the end surface thereof as best shown in FIG. 11. The pin-receiving holes 66 are aligned with corresponding pin-receiving holes 70 in the seat frame projections 50 when the rail assembly is in the fully raised position as shown in FIG. 1.

A stationary trigger plate assembly 72 is secured to the seat frame by a screw 74. This assembly includes a flat trigger projection 76 having a polymeric cover 78 mounted thereto. A mobile trigger plate 80 having a similar cover 78 includes a cylindrical extension projection from one end thereof. The extension includes a threaded axial bore. One of each pair of the seat frame projections 50 includes a cylindrical housing 82 having an unthreaded axial bore aligned with the unthreaded opening 70 therein. A spring 84 is positional within the housing 82. A plunger 86 having a threaded end extends through the spring and housing, and is threadably engaged to the threaded axial bore within the mobile trigger plate 80. The spring 84, which bears against an end well of the cylindrical housing 82 and a shoulder defined by the plunger 86, reliantly urges the plunger towards one of the rail projections.

The non-threaded end of the plunger 86 is positioned within one 66 of the two holes within the pivot arms 58 when the rail assembly 52 is in the fully raised position. It thereby locks the rail in this position. The plunger 86 is withdrawn from the hole by moving the mobile trigger towards the stationary trigger assembly 72. As the rail assembly swings downwardly, the plunger bears against the surface of the rail projection 58 until the rail arm is vertically oriented. It then moves within the notch 68 to lock the rail assembly in the lowered position. The spring 84 maintains the plunger 86 within the notch 68 until the trigger mechanism is again actuated. Due to the orientation of the arms 58 with respect to the rail assembly 52, the rail assembly is positioned beneath the seat portion 14 when in the fully lowered position and a distance from the seat portion when fully raised.

Referring now to FIGS. 5–10, a mechanism for adjusting the positions of the backrest portion 12 relative to the seat portion 14 is illustrated in detail. The mechanism allows the assembly to assume the fully reclined position shown in FIG. 4 or the Trendelenburg position wherein the backrest portion defines an obtuse angle with respect to the seat portion.

A pneumatic spring assembly 88 is pivotably mounted to the seat section 46A of the assembly 10 by a hinge pin 90. The pin extends through a pair of fixed pivot ears 92 and an opening in the base 94 of the pneumatic spring assembly.

The pneumatic spring 88 includes a shaft 96 that extends from the cylindrical casing thereof. An actuating rod 98 extends from this shaft. Movement of the rod 98 towards the shaft 96 "unlocks" the shaft and allows it to be moved in either direction with respect to the pneumatic spring casing. The rod 98 is normally positioned in opposing relation to a flat notch 100 defined in a rod member of a Trendelenburg handle assembly 102. A second handle assembly 104 is colinear with the first assembly 102. Each extends within a handle connector 106 and is secured thereto by a spring pin 108. This arrangement provides the effect of a solid shaft. Each handle assembly is rotatable within one of a pair of support angles 110 mounted to the upper backrest cross member 112. A pair of labelled handles 114 are secured to the ends of the handle assemblies. One end of each handle may include indicia stating "recline" and the other end indicating "Trendelenburg". The purpose of such labelling will be apparent when the operation of the assembly is further described.

Figure 8:
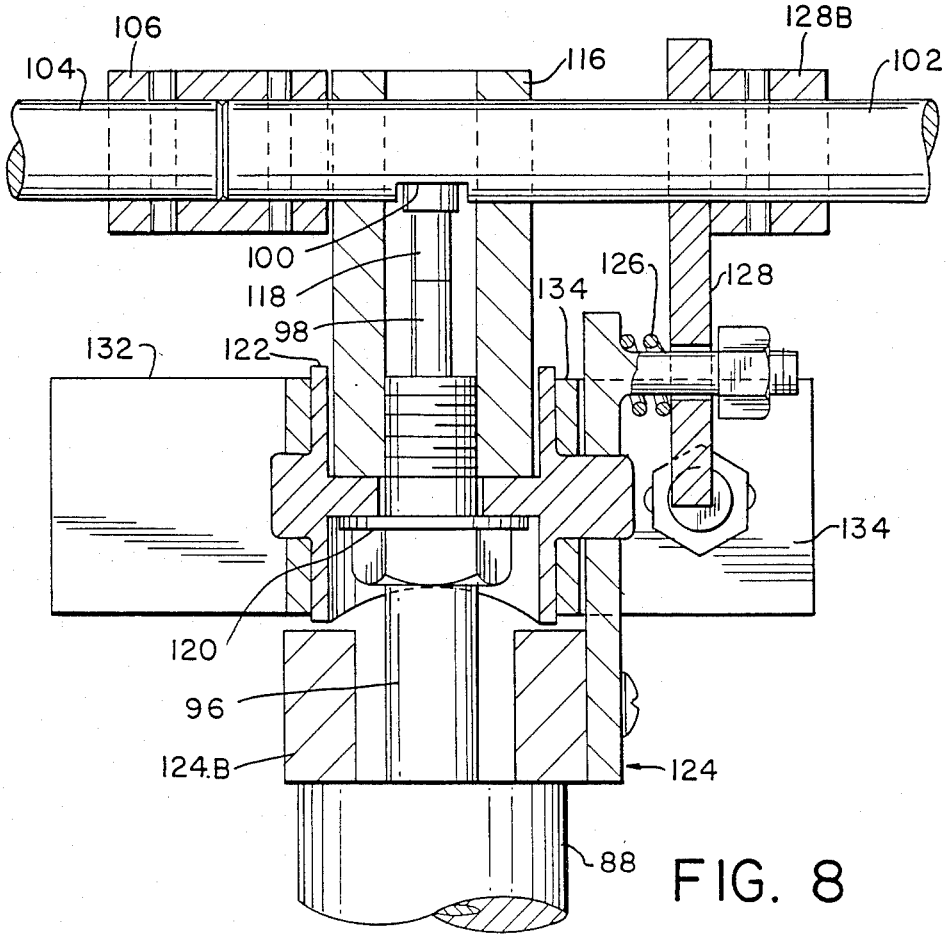
FIG. 8 is a sectional, elevation view thereof.
Figure 7:
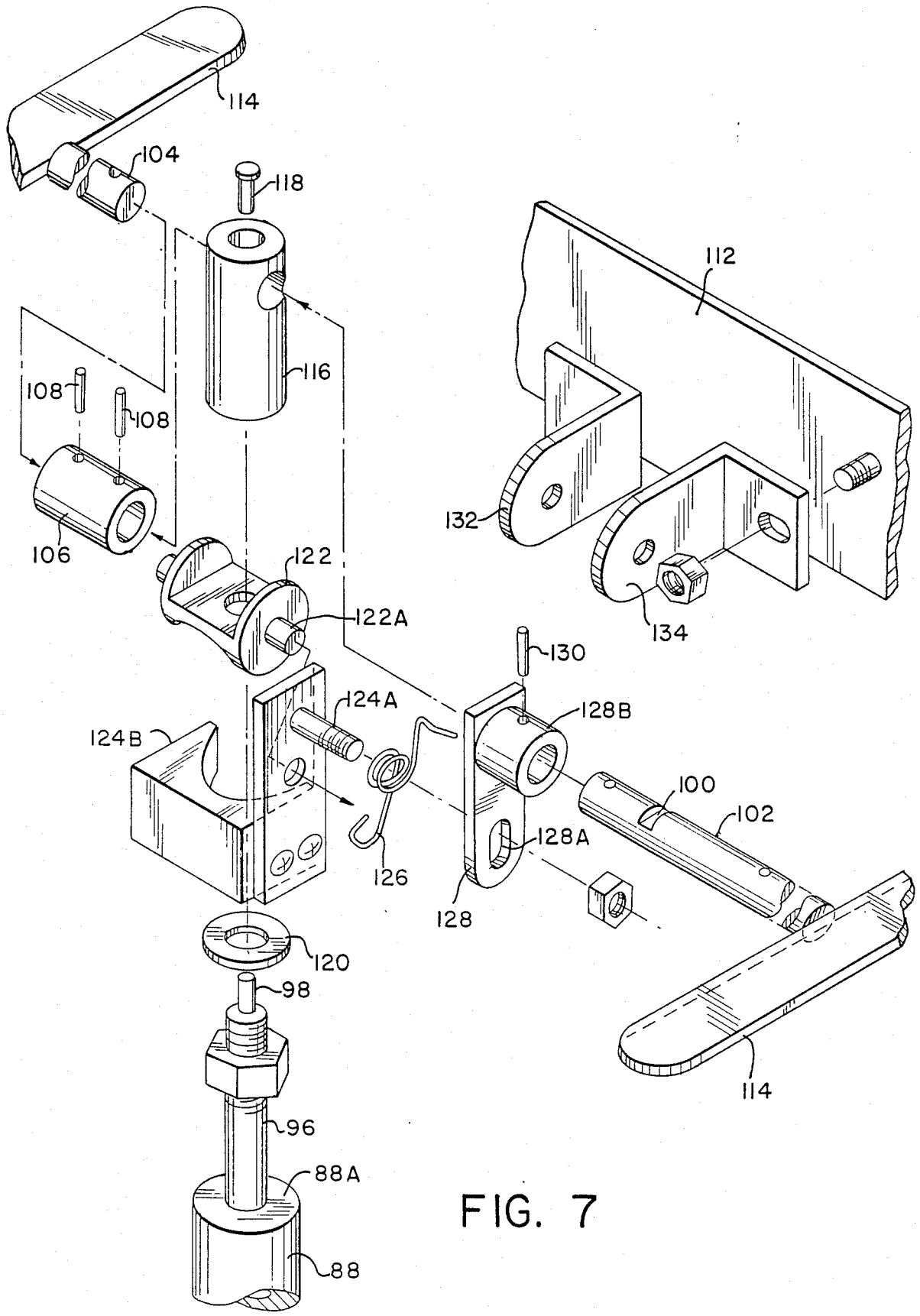
FIG. 7 is an exploded, perspective view of the backrest positioning assembly.

A pneumatic spring trigger chamber 116 is threadably secured to the end of the spring shaft 96. An actuator pin 118 is positioned within the chamber 116 between the actuating rod 98 and the flat notch 100 of the first handle assembly 102. A lock washer 120 and spring pivot 122 fit over the spring shaft 96. A stop block assembly 124 includes an opening through which a cylindrical projection 122A of the spring pivot extends. The stop block assembly is accordingly pivotable with respect thereto. A lateral projection 124A having a threaded end extends from the stop block. A release spring 126 is mounted to the projection 124A. The release spring is hooked on one end to the stop block 124 and on an opposite end to a trigger plate assembly 128. The trigger plate assembly includes a plate having an elongate opening 128A and a cylindrical projection 128B extending from the plate portion thereof. A spring pin 130 extends through an opening in the cylindrical projection 128B to secure the trigger plate assembly to the Trendelenburg handle assembly 102. A first pivot ear 132 is secured to cross member 112, and a portion thereof extends between the spring pivot 122 and stop block 124. The lateral projections 122A, 122B of the spring pivot 122 extend, respectively, through openings in the first pivot ear 132 and a seoond pivot ear 134, as shown in FIG. 8.

Figure 2:
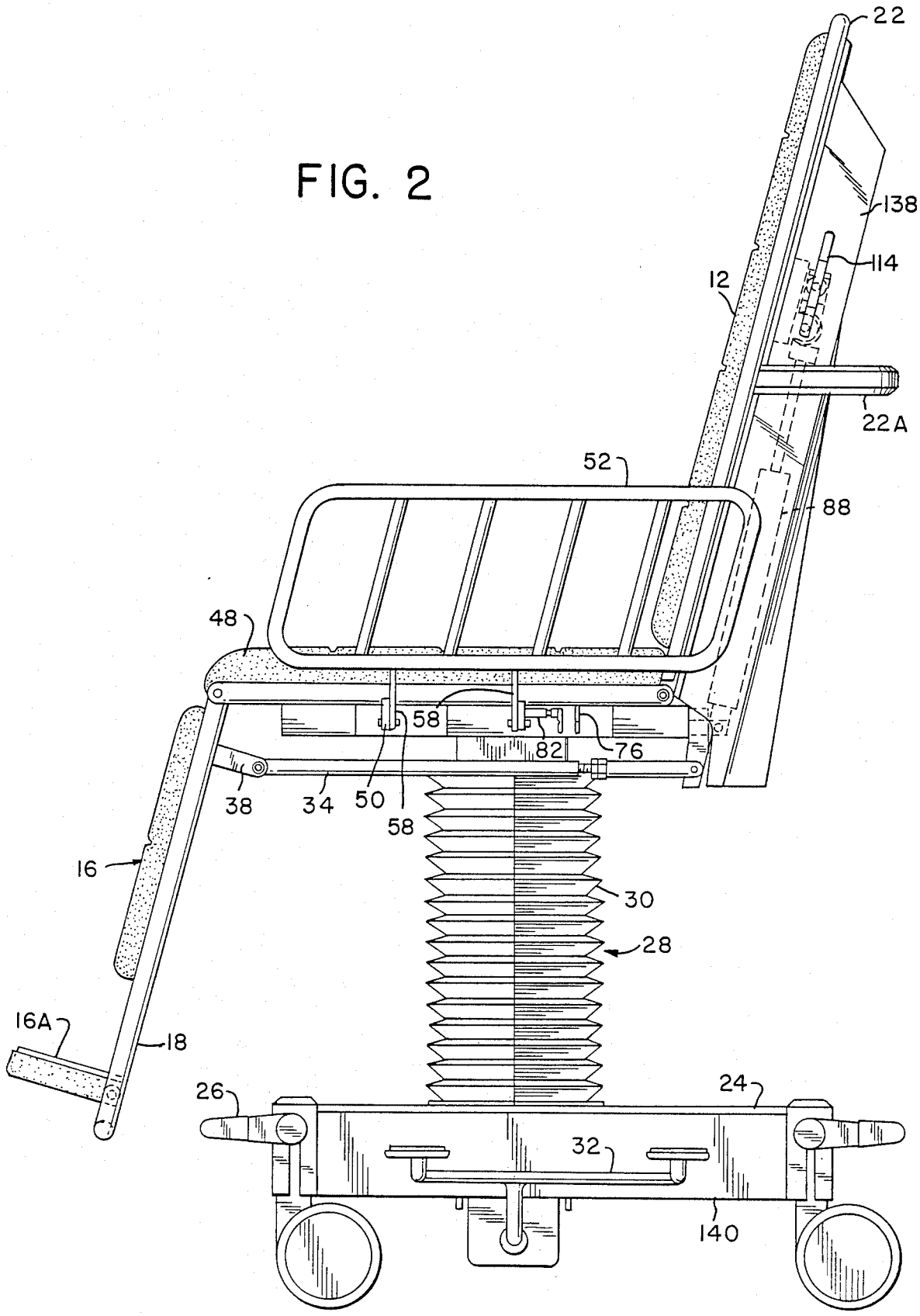
FIG. 2 is a side elevation view thereof.
Figure 3:
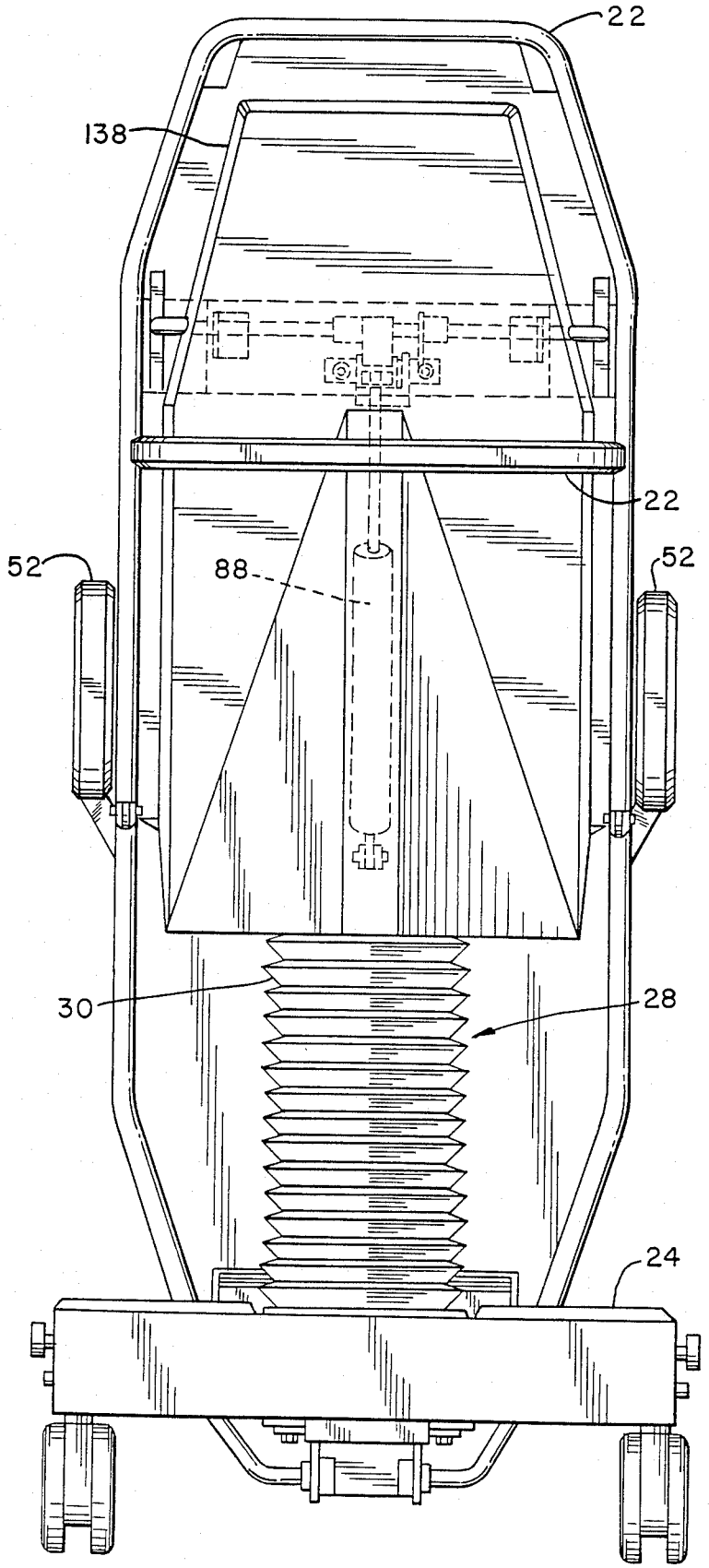
FIG. 3 is a rear elevation view thereof.
Figure 4:
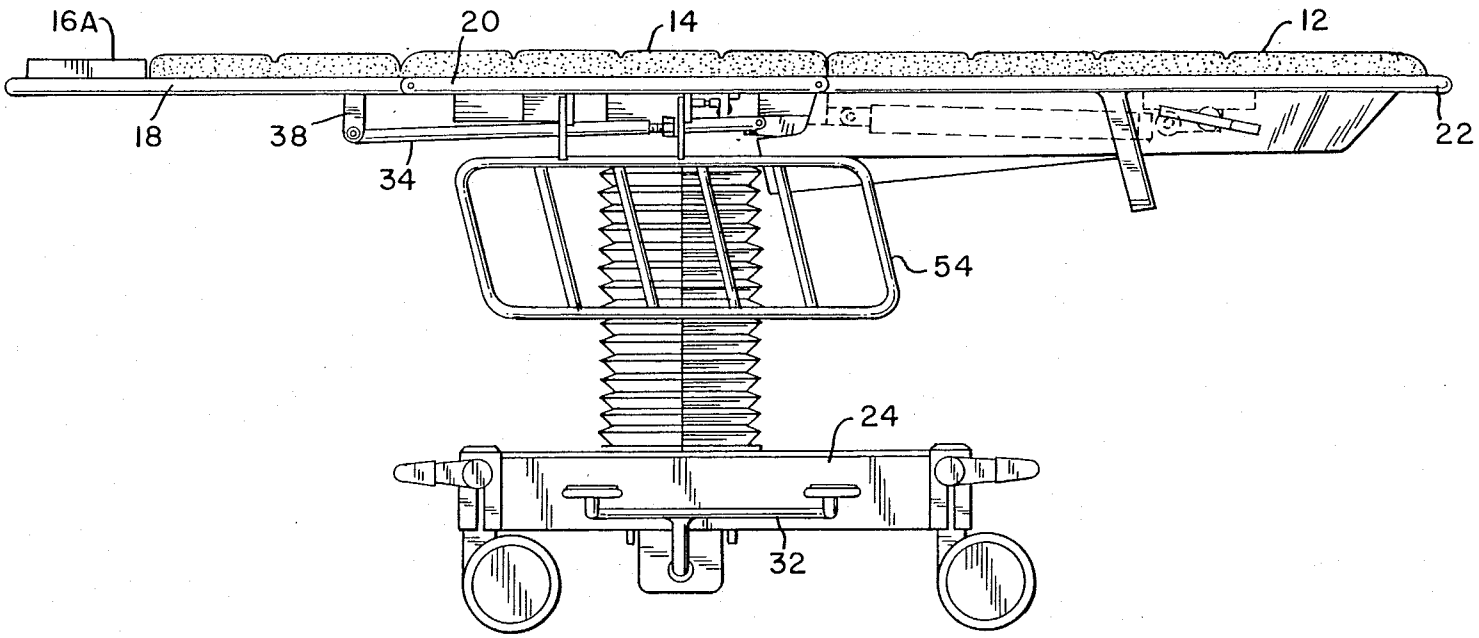
FIG. 4 is a side elevation view thereof showing the assembly as employed as a stretcher.
Figure 6:
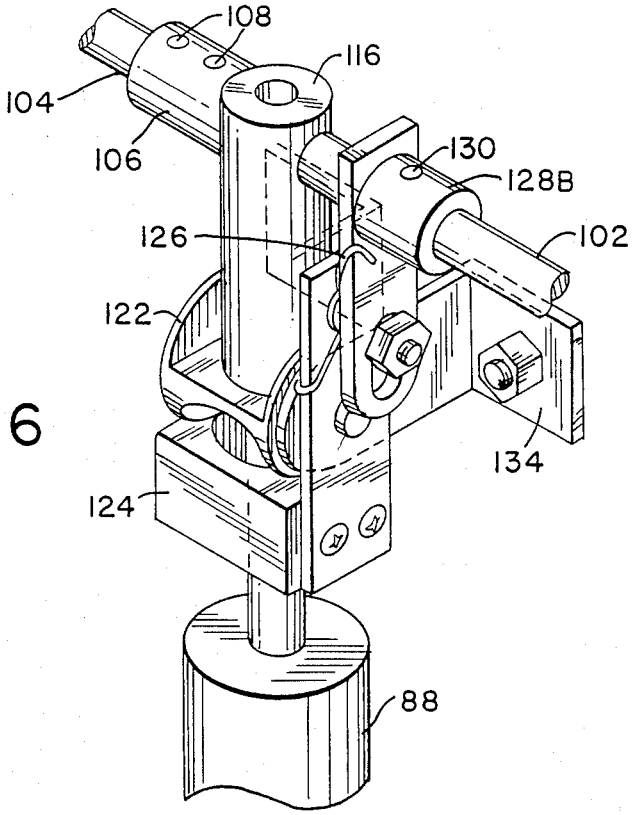
FIG. 6 is a perspective view of a portion of a backrest positioning assembly according to the invention.
Figure 9:
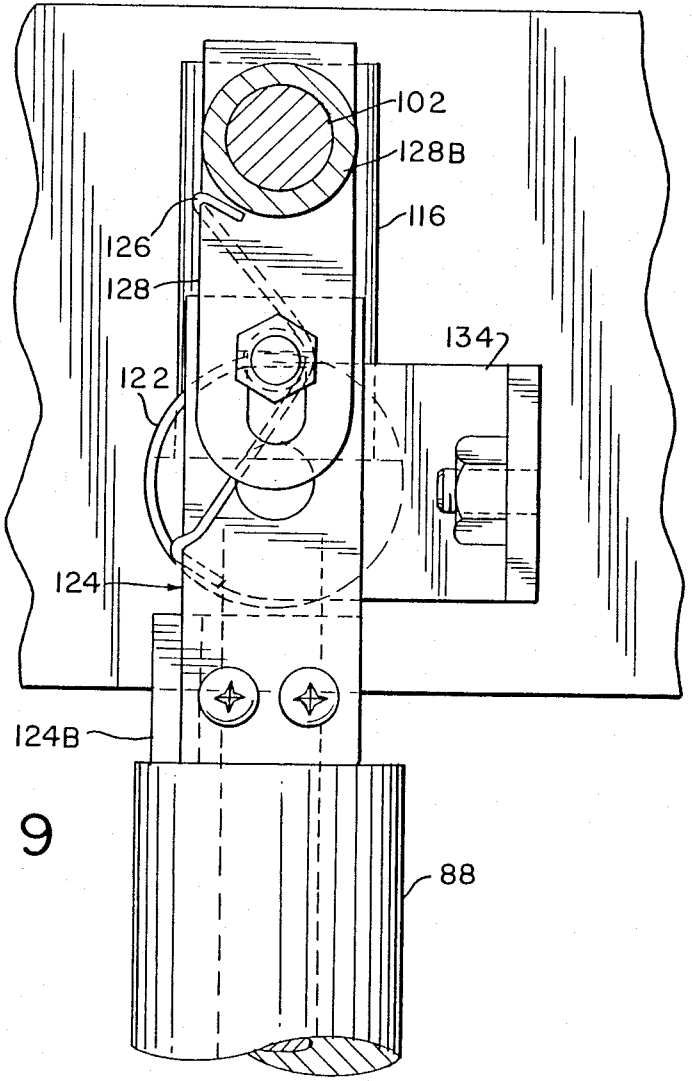
FIG. 9 is a side elevation view thereof.

The backrest adjusting mechanism allows the backrest portion 12 to be moved from the relatively upright position shown in FIG. 2 to any number of positions, including a horizontal orientation as shown in FIG. 4, or a Trendelenburg position where the backrest portion is lower than the seat portion 14. In most backrest positions, the stop block 124 is oriented such that the spring shaft 96 extends through a semi-cylindrical slot within a plastic block portion 124B thereof. FIGS. 6 and 9 show the block portion 124B in this position. The stop block is urged towards the shaft 96 by the release spring 126.

The backrest portion is moved to the recline position by turning one of the two ends of handles 114 in a first rotational direction, e.g. towards the back of chair/-stretcher assembly. The rod portion 102 (or 104) of the handle assembly is accordingly rotated such that the flat notch 100 is displaced and the actuator pin 118 pushed towards the actuating rod 98. Compression of the pneumatic spring actuating rod 98 allows the shaft 96 to move further within the spring casing as the backrest portion 12 rotates downwardly with respect to the seat portion. The pneumatic spring 88 urges the backrest portion at a controlled speed towards the reclined position when actuated. When the upper surface of the fully reclined spring casing abuts the lower surface of the stop block 124 as shown in FIG. 8, further downward rotational movement of the backrest portion is precluded.

Figure 10:
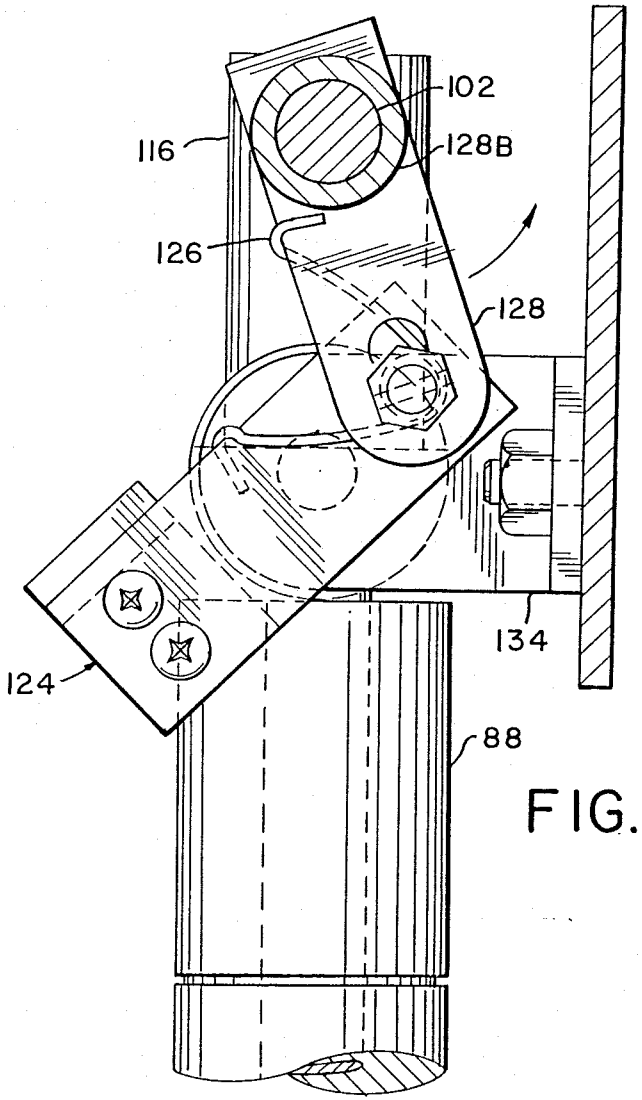
FIG. 10 is a side elevation view thereof showing said assembly when in the Trendelenburg position.

To provide further compression of the pneumatic spring 88, thereby allowing the backrest position 12 to move beyond a horizontal orientation and into, for example, a ten degree Trendelenburg position, the other of the two ends of handle 114 is rotated towards the back of the chair/stretcher assembly. Rotation of shaft 102 (or 104) in this direction causes the trigger plate assembly 128 to rotate about the shaft 102. The stop block 124, being pivotable about the lateral projection 122A of the spring pivot 122, is urged away from the pneumatic spring shaft 96 as a force is exerted upon projection 124A by the trigger plate assembly 128. This allows the shaft 96 to move further within the spring casing than when the handle 114 is turned in the opposite direction as the stop block 124 does not contact the pneumatic spring casing. The shaft 96 is free to move an additional distance equal to the height of the plastic block portion 124B until the upper surface 88A of the pneumatic spring casing contacts the lower surfaces of the pivot ears 132,134. In the preferred embodiment of the invention, this distance corresponds to approximately a ten degree rotation below horizontal of the backrest assembly. FIG. 10 illustrates the positions of the stop block 124, trigger plate assembly 128, and pneumatic cylinder casing when the backrest is in a Trendelenburg position.

The upper surfaces of the back, seat and leg frames are covered with steel panels 136, one of which is partially exposed in FIG. 1. The panels are covered with contoured, vinyl-covered foam cushions attached to all sections with hook and loop type fasteners. The base frame and rear portion of the backrest are covered with formed plastic covers 138, 140 that provide a smooth, seamless covering for most of the hardware described above.

It will be appreciated by those skilled in the art that the chair/stretcher assembly 10 disclosed herein may be used for a number of functions. In the chair position, it may be used as a conventional mobile chair. The assembly may also be used as a recovery apparatus, such as a stretcher, an examination table, or other device due to its height adjustability in any position from chair to stretcher. Minor surgery, such as ophthalmic cataract removal, can be performed in a stretcher position to a semi-reclined position without moving the patient from the apparatus. In summary, the chair/stretcher assembly allows a medical facility to admit patients, move them to an examining or treatment area, prep, treat and transport them to a recovery or discharge area, all with a single piece of equipment.

What is claimed is:

1. An apparatus for supporting a person comprising:
a seat assembly;
a backrest assembly;
means for pivotably mounting said backrest assembly adjacent to said seat assembly;
a support member secured to said backrest assembly, said support member being extensible or contractible depending upon the direction of rotation of said backrest assembly with respect to said seat assembly;
means for locking said support member at a selected length;
first stop means for preventing said backrest assembly from rotating beyond a recline position wherein an upper surface thereof is substantially coplanar with respect to an upper surface of said seat assembly;
actuating means for unlocking said support member, thereby allowing said support member to expand or contract, said actuating means including means for moving said first stop means to a first or a second position as it unlocks said support member, said first stop means preventing rotation of said backrest assembly beyond said recline position when in said first position, but not prevening such rotation when in said second position.

2. An apparatus as defined in claim 1 including second stop means, said second stop means preventing said backrest assembly from rotating more than a selected distance beyond said recline position.

3. An apparatus as defined in claim 1 wherein said actuating means includes a rod rotatable about its longitudinal axis, said first stop means being connected to said rod and movable in response to the rotation of said rod.

4. An apparatus as defined in claim 2 wherein said support member is a pneumatic spring assembly including a casing and a shaft extending from said casing.

5. An apparatus as defined in claim 4 wherein said rod includes a flat notch therein, said actuating means further including an actuation member positioned between said flat notch and an end of said shaft.

6. An apparatus as defined in claim 4 including means resiliently urging said stop member towards said first position.

7. An apparatus as defined in claim 4 wherein said stop member includes a stop block having a groove therein, said shaft being positioned within said groove when said stop member is in said first position.

8. An apparatus as defined in claim 1 wherein said support member includes one end portion mounted to said backrest assembly and an opposite end portion mounted to said seat assembly.

9. An apparatus as defined in claim 3 including means for maintaining said first stop means in said first position when said rod is rotated in a first direction, but allowing said first stop means to move to said second position when said rod is rotated in a second direction.

10. An apparatus for supporting a person comprising:
a seat assembly;
a backrest assembly;
means for pivotably mounting said backrest assembly adjacent to said seat assembly;
a pneumatic spring assembly secured to said backrest assembly, said pneumatic spring assembly including a casing and a shaft extending from said casing, said pneumatic spring assembly being extensible or contractible depending upon the direction of rotation of said backrest assemoly with respect to said seat assembly, said casing including an upper surface from which said shaft extends;
means for locking said pneumatic spring assembly at a selected length;
stop means including means for preventing said backrest assembly from rotating beyond a recline position wherein an upper surface thereof is substantially coplanar with respect to an upper surface of said seat assembly and means for preventing said backrest assembly from rotating more than a selected distance beyond said recline position, said stop means including an abutment positioned in opposing relation to said upper surface of said casing and a stop member;

actuating means for unlocking said support member, thereby allowing said support member to expand or contract, said actuating means including a rod rotatable about its longitudinal axis, said stop member being connected to said rod, said stop member being movable upon rotation of said rod between a first position wherein said stop member is positioned between said upper surface of said casing and said abutment and a second position wherein said stop member is not positioned between said upper surface of said casing and said abutment, said backrest assembly being movable beyond said recline position when said stop member is in said second position, said abutment being engageable with said upper surface of said casing to prevent said backrest assembly from rotating more than a selected distance beyond said recline position.

11. An apparatus as defined in claim 3 including a handle connected to said rod.

12. An apparatus as defined in claim 1 wherein said support member includes a casing and a shaft extending from said casing, said casing including an upper surface from which said shaft extends.

13. An apparatus as defined in claim 12 including an abutment extending from said backrest assembly and in opposing relation to said upper surface of said casing, said first stop means being positioned between said abutment and said upper surface when in said first position, thereby preventing said backrest assembly from rotating beyond a recline position.

* * * * *

UNITED STATES PATENT AND TRADEMARK OFFICE

CERTIFICATE OF CORRECTION

PATENT NO. : 4,858,260

DATED : August 22, 1989

INVENTOR(S) : Raymond A. Failor, Eugene Hayton, Mark Reuter

It is certified that error appears in the above-identified patent and that said Letters Patent is hereby corrected as shown below:

Column 4, line 45, "seoond" should read — second —

Column 6, line 14, "prevening" should read — preventing —

Column 6, line 58, "assemoly" should read — assembly —

Signed and Sealed this

Twenty-fourth Day of July, 1990

*Attest:*

HARRY F. MANBECK, JR.

*Attesting Officer*

*Commissioner of Patents and Trademarks*